US009061790B2

(12) United States Patent
Yagishita

(10) Patent No.: US 9,061,790 B2
(45) Date of Patent: Jun. 23, 2015

(54) PACKING MEMBER FOR ARTICLES

(75) Inventor: Hiromasa Yagishita, Odawara (JP)

(73) Assignee: Toshiko Hiraishi, Tokyo (JP)

( * ) Notice: Subject to any disclaimer, the term of this patent is extended or adjusted under 35 U.S.C. 154(b) by 1082 days.

(21) Appl. No.: 12/451,639

(22) PCT Filed: May 26, 2008

(86) PCT No.: PCT/JP2008/060098

§ 371 (c)(1),
(2), (4) Date: Jan. 28, 2010

(87) PCT Pub. No.: WO2008/146931

PCT Pub. Date: Dec. 4, 2008

(65) Prior Publication Data

US 2010/0133328 A1 Jun. 3, 2010

(30) Foreign Application Priority Data

May 24, 2007 (JP) ..... 2007-138436

(51) Int. Cl.

| | |
|---|---|
| ***B65D 27/04*** | (2006.01) |
| ***B65D 5/42*** | (2006.01) |
| ***B65D 5/355*** | (2006.01) |
| ***B65D 5/50*** | (2006.01) |

(52) U.S. Cl.
CPC ..... *B65D 5/4229* (2013.01); *B65D 5/0005* (2013.01); *B65D 5/5038* (2013.01)

(58) Field of Classification Search
CPC .. B65D 5/0005; B65D 5/5038; B65D 5/4229; B65D 5/4216; B65D 5/4212; B65D 27/04
USPC ..... 206/736, 764, 765, 459.5, 756, 45.28, 206/223, 575, 488, 45.25; 229/102.5, 71
See application file for complete search history.

(56) References Cited

U.S. PATENT DOCUMENTS

| | | | | |
|---|---|---|---|---|
| 1,991,640 | A * | 2/1935 | Taylor | 217/3 BC |
| 3,353,658 | A * | 11/1967 | Ettin | 206/45.25 |
| 3,732,976 | A * | 5/1973 | Bessett et al. | 206/499 |
| 4,440,298 | A * | 4/1984 | Knight | 206/216 |
| 5,595,297 | A * | 1/1997 | Borck et al. | 206/387.13 |
| 5,725,144 | A * | 3/1998 | Stone et al. | 229/101 |

(Continued)

FOREIGN PATENT DOCUMENTS

| | | |
|---|---|---|
| JP | U S51-84398 | 7/1976 |
| JP | U3043422 | 9/1997 |

(Continued)

*Primary Examiner* — Steven A. Reynolds
(74) *Attorney, Agent, or Firm* — Manabu Kanesaka

(57) ABSTRACT

A packing member for articles which can covey a particular individual message to a recipient of articles and allows the recipient to keep the particular individual message as a remembrance is provided.

A message board MB straddles two outer flaps 1B, 1B which constitutes the top surface of a cardboard box 1. The message board MB is partitioned by a perforated line 1C, 1C so that the message board MB can be cut out from the two outer flaps 1B, 1B. A handwritten particular individual message addressed to a recipient from a sender of articles is copied to the message board MB. When the cardboard box 1 is delivered to a recipient, the hearty particular individual message from the sender is conveyed to the recipient. The recipient can keep the message board MB with the handwritten particular individual message as a remembrance by cutting out the message board MB along the perforated line 1C, 1C.

11 Claims, 13 Drawing Sheets

(56) References Cited

U.S. PATENT DOCUMENTS

| | | | | |
|---|---|---|---|---|
| 5,794,631 | A * | 8/1998 | Sylvester | 206/387.1 |
| 6,375,225 | B1 * | 4/2002 | Lapsker | 283/56 |
| 6,394,336 | B1 * | 5/2002 | Beneroff et al. | 229/101 |
| 7,264,123 | B2 * | 9/2007 | Reed | 206/765 |
| 2002/0162757 | A1 * | 11/2002 | Parsons | 206/232 |
| 2005/0150939 | A1 * | 7/2005 | Fakes et al. | 229/235 |

FOREIGN PATENT DOCUMENTS

| | | |
|---|---|---|
| JP | 2000-296838 | 10/2000 |
| JP | U3108181 | 1/2005 |
| JP | 2006-001646 | 1/2006 |
| JP | 2006-111297 | 4/2006 |
| JP | 2006-160270 | 6/2006 |

* cited by examiner

PACKING MEMBER FOR ARTICLES

TECHNICAL FIELD

This invention relates to a packing member for articles which is used for sending articles to a recipient.

BACKGROUND ART

As a packing member for articles which is used for sending articles to a recipient, a lightweight and heavy-duty cardboard box is usually used. This type of cardboard box is called an individual packing cardboard box for packing a minimum unit of articles. At least the address and the name of the recipient of articles is displayed on such an individual packing cardboard box. The name of articles, or the trademark or service mark of the manufacturer, dealer or distributer of articles can be additionally displayed on the cardboard box by printing in advance (see e.g. Japanese Laid-Open Patent Application Tokkai 2001-294225).

DISCLOSURE OF INVENTION

Problems to be Resolved by Invention

Although the aforementioned individual packing cardboard box can have a certain messaging capability by the name of articles, trademark or service mark, it does not have a functionality of conveying a particular individual message to a recipient of articles because its fundamental functionality is to pack and send articles in safety. The purpose of the present invention is to provide a packing member for articles which can convey a particular individual message to a recipient of articles and allows the recipient to keep the particular individual message as a remembrance.

Means for Resolving Problems

In order to resolve the problem, a packing member for articles according to the present invention is configured as a box shape or an envelope shape packing member for articles which is used for sending articles to a recipient. The packing member has a message display portion for displaying a particular individual message addressed to a recipient by a sender, and the message display portion can be removed from the packing member.

When an article is to be sent to a recipient by using a packing member for articles according to the present invention, a particular individual message which is addressed to a recipient is displayed on the message display portion which can be separated from the packing member. According to this configuration, when the article is delivered to the recipient, the mind of the sender of the article is conveyed to the recipient through the particular individual message which is displayed on the message display portion of the packing material for articles. It is preferable to use a hand-written message by a sender or its copy as a particular individual message because the sender's mind and personal image is conveyed to the recipient warmly and the value of a memory message board as a remembrance is more increased. The recipient can keep the message display portion as a remembrance by separating the message display portion from the packing member for articles. A packing member for articles according to the present invention can have either a box shape or an envelope shape based upon the shape, size, number, etc. of articles to be sent. For example, an envelope shape is chosen for thin and flat articles, e.g. CDs, DVDs, magazines, T-shirts, and a box shape is chosen for non-flat articles, e.g. fruits like oranges or apples, bottles of jam.

In a packing member for articles according to the present invention, the message display portion for displaying a particular individual message can be configured to be cut out from the packing member, or the message display portion can be configured by a separate message sheet which can be peeled off from the packing member.

A packing member for articles according to the present invention can be made of any kind of materials, e.g. paper, wood, plastic, cloth, as long as the message display potion can be separated from the packing member. It is preferable to use a box shape or an envelope shape packing member for articles which is made of cardboard material because it has a lightweight and heavy-duty property and the message display portion can be easily cut out from the packing member.

It is preferable to make a box shape or an envelope shape packing member for articles by a transparent or translucent plastic material because a recipient of articles is pleased to see the contained articles through the packing member clearly.

It is especially preferable to make a packing member for articles for sending fruits, sweets or beverages by a transparent or translucent plastic cardboard box with a light color which is connected to the color of the fruits, sweets or beverages in it.

A packing member for articles according to the present invention is made of a cardboard box having two flips on the top surface wherein a message board as a message display portion straddles the two flips, the message board can be cut out from the two flaps, and the message board portion in the two flaps are stitched each other by staples.

In this type of packing member for articles, it is advantageous to have staples or their trace on the message board which is cut out from the two flaps because it increases the value of the message board as a remembrance.

A packing member for articles according to the present invention can be made of a cardboard box having one flap on the top surface wherein a message board as a message display portion is included in the flap, and a particular individual message is displayed on at least the inner surface or the outer surface of the message board.

In this type of packing member for articles, it is advantageous to prevent other people (excluding the recipient of articles) from seeing the particular individual message by display the particular individual message on the inner surface of the message board, and therefore the sender of articles can display a particular individual message without regard for what others think about the message.

A packing member for articles according to the present invention can include a volume adjustable plastic box with an accordion structure and a plastic cover which covers the opening of the box, wherein a separate message sheet as the message display portion is attached to the inner surface of the cover and the message sheet can be peeled-off from the inner surface of the cover.

In this type of packing member for articles, for example, the volume of the box can be changed by the accordion structure so as to easily accommodate either 3 kg or 5 kg of fruits like oranges.

The box and cover can be reused by peeling off the separate message sheet which displays a particular individual message as a message display portion from the inner surface of the cover.

A sender of articles can display a particular individual message without regard for what others think about the message because it can prevent other people from seeing the particular individual message.

It is preferable to contain a frame together with articles in the packing member for articles, wherein the frame can be used for setting up the message display portion which is separated from the packing member, because the value of the message display portion as a remembrance is more increased by setting up the message display portion in the frame as a remembrance.

It is preferable to include a pad member for supporting articles in the packing member for articles, wherein the pad member has a structure which can be converted to a frame because the message display portion can be set up as a remembrance with a frame by converting the pad member to a frame, and therefore the recipient of articles can recall the articles which were presented by the sender by looking at the frame and it increases the value as a remembrance.

It is advantageous to include an order form for ordering new articles together with articles in the packing member for articles according to the present invention because a recipient of articles can easily and certainly order new articles using the order form which is taken out together with the articles from the packing member. It is advantageous to include a space for handwriting a particular individual message in the order form because a recipient of articles (i.e. a sender of new articles) can write a handwritten particular individual message addressed to a recipient of new articles.

This space in the order form can be attached to a message sheet in a removable manner. This space itself also can be a message sheet which is removable from the order form.

In this configuration, it is more convenient because a handwritten message by a sender can be easily attached to a packing member for articles according to the present invention.

Effect of Invention

In a packing member for articles according to the present invention, a particular individual message can be conveyed to a recipient of articles by displaying a particular individual message addressed to a recipient of articles on a message display portion which is removable from the packing member. The recipient of articles can keep the message display portion displaying a particular individual message as a remembrance by separating the message display portion from the packing member for articles.

In this case, if the particular individual message is a handwritten message by a sender of articles, a warm mind and personal image of the sender can be conveyed to a recipient and the vale of the message display portion as a remembrance can be increased.

| REFERNCE NUMERALS | |
|---|---|
| 1, 11 | cardboard box |
| 1A, 11A | ridge line |
| 1B, 11B | outer flap |
| 1c, 11C | perforated line |
| 2 | staple |
| 3 | pad member |
| 3A | mountain fold line |
| 3B | cut |
| 3C | fold piece |
| 3D | mountain fold line |
| 3E | fold piece |
| 3F | perforated line |
| 3G | cut |
| 3H | frame |
| 21 | packing box |
| 21A | box |
| 21B | cover |
| 21C | accordion structure portion |
| 21D | closing cover |
| 22, 32 | message sheet |
| 31 | packing bag |
| 31A | gusset |
| MB | message board |
| BJ | bottle of jam |
| OS | order form |

EMBODIMENT

The best mode of a packing member for articles according to the present invention will be explained referring to drawings. In the referred drawings, FIG. 1 is a perspective view for showing the appearance of a cardboard box as a packing member for articles according to a first embodiment, and FIG. 2 shows a top view for showing the top surface of the cardboard box shown in FIG. 1.

Figure 1:
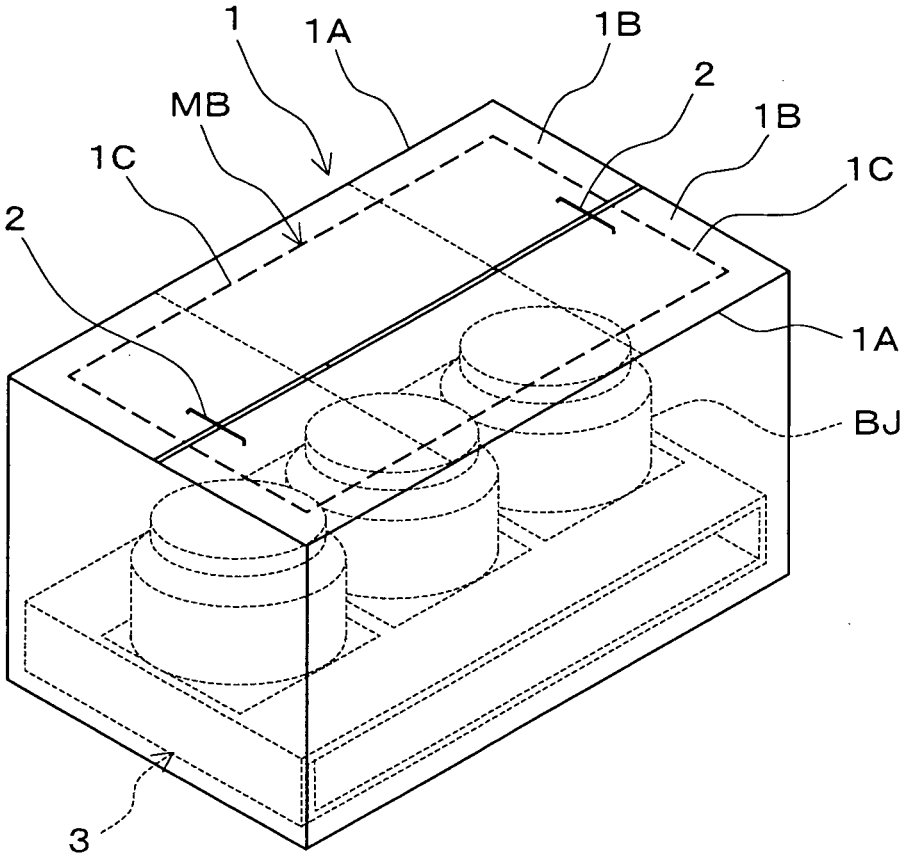
FIG. 1 shows a perspective view for showing the appearance of a cardboard box as a packing member for articles according to a first embodiment of the present invention.
Figure 2:
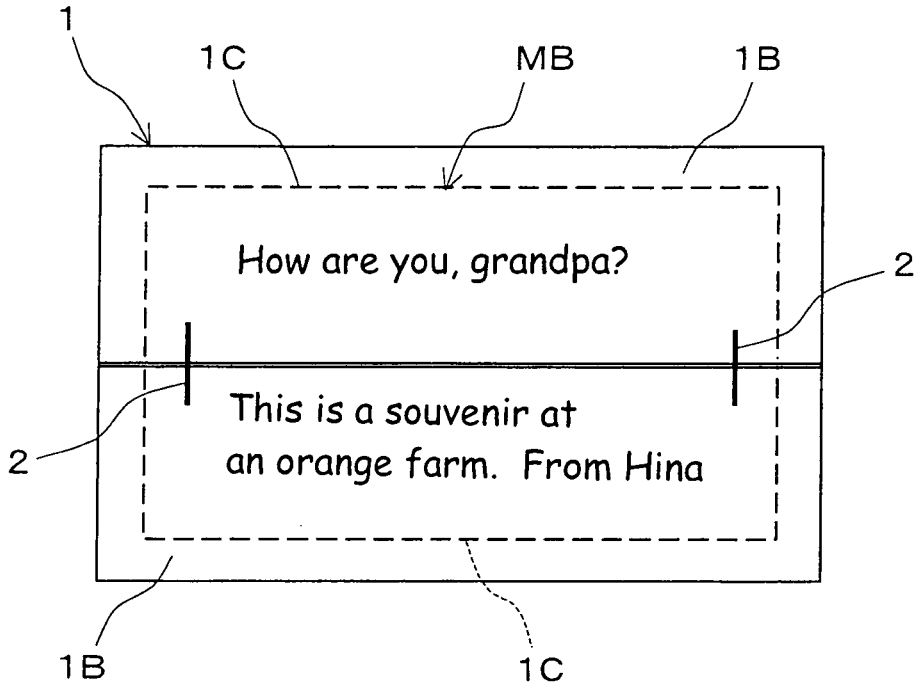
FIG. 2 shows a top view for showing the top surface of the cardboard box shown in FIG. 1.

A packing member for articles according to the first embodiment is configured as a cardboard box 1 shown in FIG. 1, for example. As shown in FIG. 1, the top surface of the cardboard box 1 comprises two landscape outer flaps 1B, 1B which are folded toward the inner side along the ridge lines 1A, 1A which extend in a longitudinal direction. The two outer flaps 1B, 1B are stitched each other by driving staples 2, 2 by using a stapler (not shown in drawings), As shown in FIG. 2, the top surface of the cardboard box 1 comprises two outer flaps 1B, 1B and a rectangular message board MB as a message display portion straddles the two outer flaps 1B, 1B, and the message board MB is partitioned by perforated lines 1C, 1C so as to be cut out from the two outer flaps. A particular individual message addressed to a recipient from a sender of articles is displayed on the message board MB.

One example of the particular individual message is a hearty message addressed to a grandfather from his grandchild like "How are you, grandpa? This is a souvenir at an orange farm. From Hina." This particular individual message is displayed as a copy of a handwritten message on a predetermined form.

A handwritten message on a predetermined form can be copied by using a conventional well-known handheld printer as shown in Japanese Laid-Open Patent Applications (see Tokkai Hei 11-58850, Tokkai 2001-96846, Tokkai 2006-341604). A handwritten message on a predetermined form is copied by using this type of handheld printer to the message board which straddles the two outer flaps 1B, 1B on the top surface of the cardboard box 1.

A pad member 3 is fitted to the bottom portion in the cardboard box 1 shown in FIG. 1 in order to support articles without backlash. For example, three bottles of jam as articles are supported in the pad member 3. This pad member 3 is formed by folding a cardboard member to form a hollow thick plate and sticking the both ends using glue so as to have a rectangular planner shape fitted in the inner side of the cardboard box 1.

Three mountain fold lines 3A and across cuts 3B on the diagonal line of each of the mountain fold lines 3A. Three square recesses are formed by mountain-folding each fold piece 3C along each of the mountain fold lines 3A so that three bottles of jam BJ are fitted in the recesses, wherein each fold piece 3C is separated by the across cuts 3B.

Figure 4:
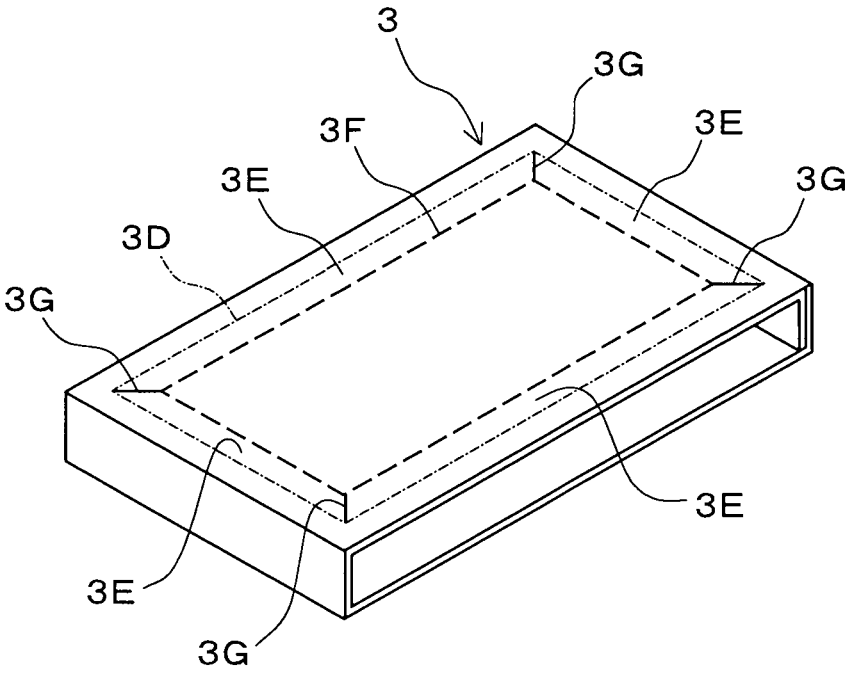
FIG. 4 shows a perspective view for showing the bottom surface side of the pad member shown in FIG. 3.

The pad member 3 is configured to function as a frame for supporting a message board MB by fitting with the message board MB which is cut out from the outer flap 1B, 1B shown in FIG. 2 along the perforated lines 1C, 1C. As shown in FIG. 4, the bottom surface of the pad member 3 includes a rectangular mountain hold line 3D corresponding to the outline of the message board MB, a rectangular perforated line 3F for cutting out four fold pieces 3E which are folded toward inside along the four sides of the mountain fold line 3D and four cuts 3G for separating each fold piece 3E so as to make it foldable.

Figure 5:
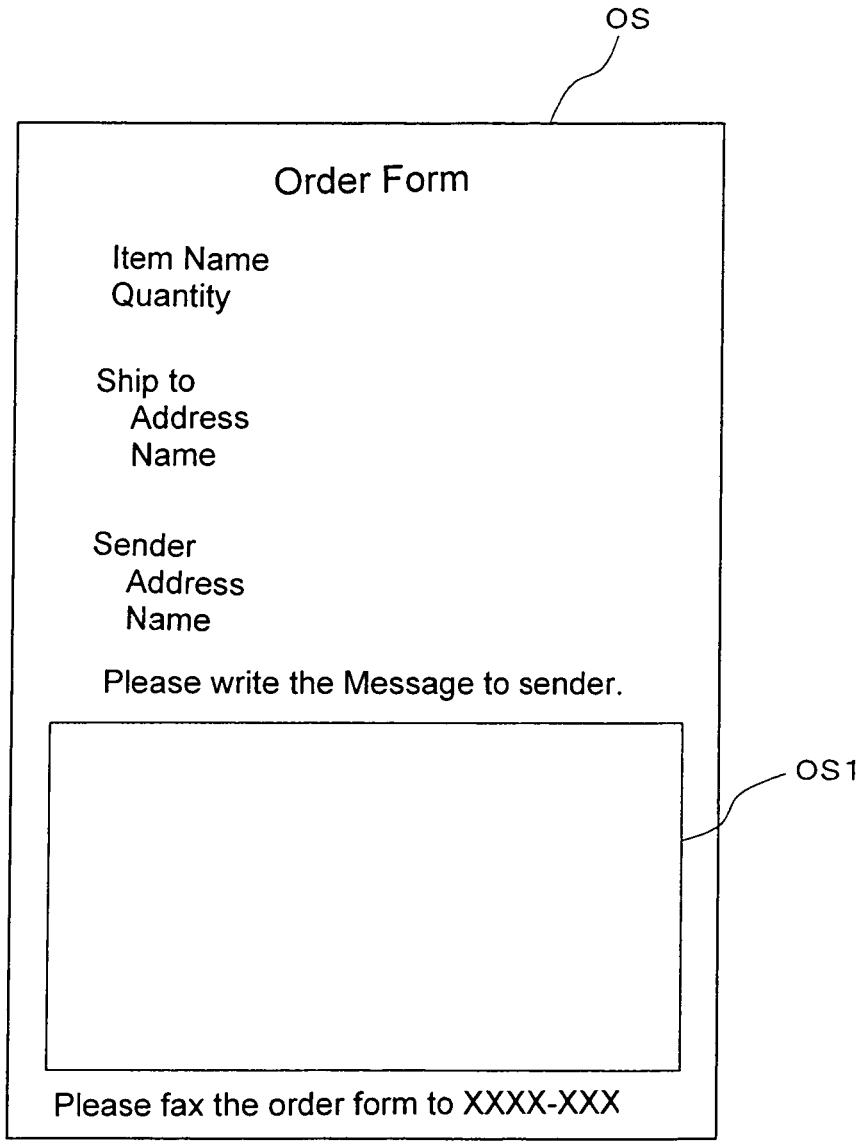
FIG. 5 shows a front view for showing a new order form which is contained in the cardboard box shown in FIG. 1.

The cardboard box 1 shown in FIG. 1 contains three bottles of jam BJ supported by the pad member 3, a frame assemble instruction drawing (not shown in drawings) for converting the pad member 3 to a frame for the message board MB by folding and an order from OS for a new order of articles shown in FIG. 5. The order form OS includes a message space OS1 where a particular individual message addressed to a recipient from a sender of articles can be handwritten at the time of an order of new articles. The particular individual message handwritten in the message space OS1 of the order form OS is copied to the message board MB on the top surface of the cardboard box 1 when new articles are contained in a new cardboard box 1 for sending to a recipient.

Although it is not sown in drawings, when the message space OS1 is configured so as to be easily removed from the order form OS, the message space is removed from the order form and stuck on the message board MB, and when a message sheet is attached to the message space OS1 and removable from the message space OS1, the message sheet can be removed from the message space OS1 and stuck on the message board MB.

Figure 3:
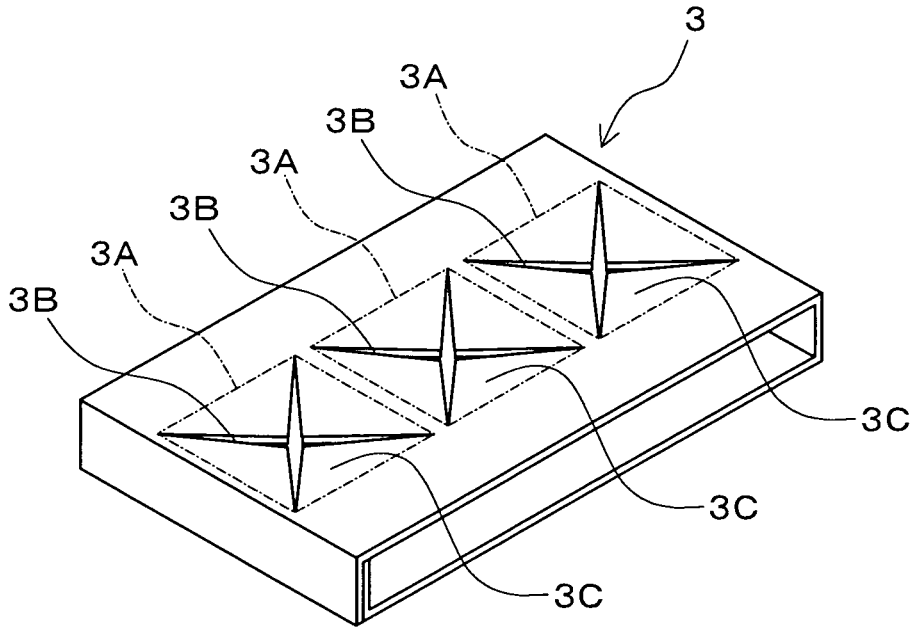
FIG. 3 shows a perspective view for showing the top surface side of a pad member which is contained in the cardboard box shown in FIG. 1.

The cardboard box 1 according to one embodiment configured as described in the above is used for sending articles, e.g. three bottles of jam BJ to a recipient. In this case, the cardboard box 1 is assembled in a condition that the two outer flaps 1B, 1B shown in FIG. 1 can be opened, and then the pad member 3 (see FIG. 3) is fitted in the bottom portion of the cardboard box 1, Each of three bottles of jam BJ is supported without backlash by respectively fitting in each of the three square recesses which are formed on the top surface of the pad member 3.

After that, the order form shown in FIG. 5 and the frame assemble instruction drawing (not shown in drawings) are contained in the cardboard box 1, and an appropriate cushion member is packed in the vacant space in the cardboard box 1. The both sides of the two outer flaps 1B, 1B of the cardboard box 1 are stitched each other by driving staples 2, 2 using a stapler (not shown in drawings).

A particular individual message, like the message shown in FIG. 2, i. e. "How are you, grandpa? This is a souvenir at an orange farm. From Hina." is copied to the rectangular message board MB which straddles the two outer flaps 1B, 1B by using a handheld printer (not shown in drawings).

The three bottles of jam BJ are packed in the cardboard box 1 as shown in FIG. 1 and sent to a recipient of articles. When the cardboard box 1 is delivered to the recipient, the particular individual message displayed on the message board MB on the top surface of the cardboard box 1 is seen by the recipient, and the mind of the sender of articles is conveyed to the recipient by the particular individual message.

A particular individual message like the aforementioned hearty particular individual message, i.e. "How are you, grandpa? This is a souvenir at an orange farm. From Hina." is displayed as a copy of a handwritten message on the message board MB. Furthermore, the message can be either a directly handwritten message on the message board MB or a message removed from the order form and stuck on the message board MB by glue. The mind and personal image of a sender of articles can be warmly conveyed to a recipient before the recipient sees the articles, i. e. the bottles of jam BJ. It causes the recipient a mind of keeping the message board MB as a remembrance.

Figure 6:
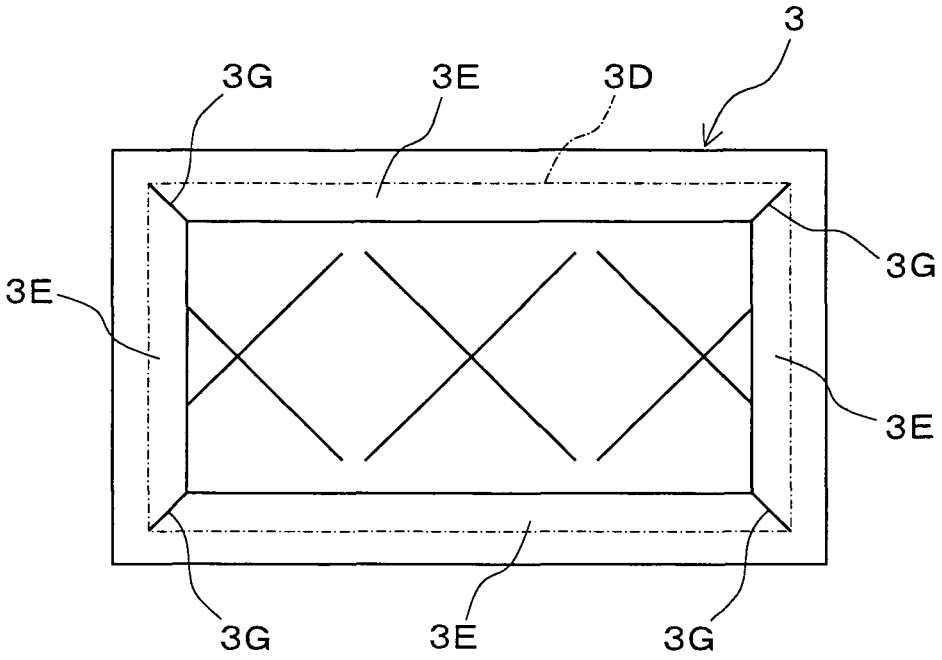
FIG. 6 shows a rear view of a pad member for showing the condition when each folding piece shown in FIG. 4 is cutout.
Figure 7:
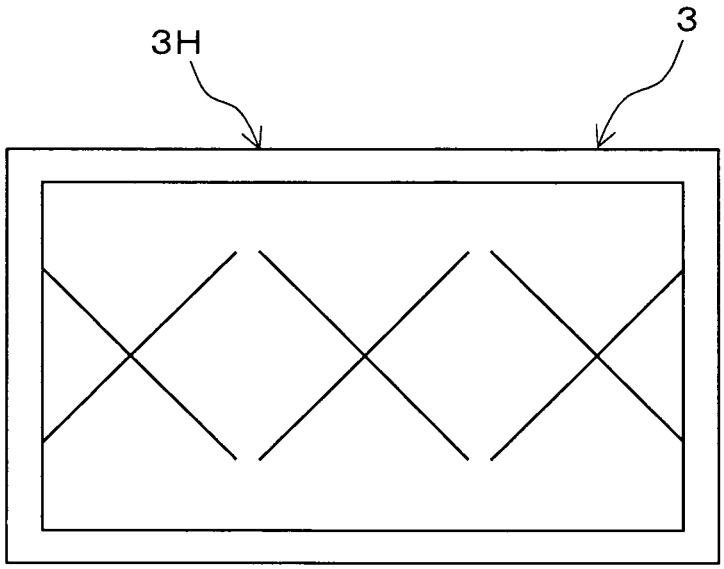
FIG. 7 shows a front view for showing a frame which is made from the pad member in a condition when each folding piece shown in FIG. 6 is folded toward the inner side.
Figure 8:
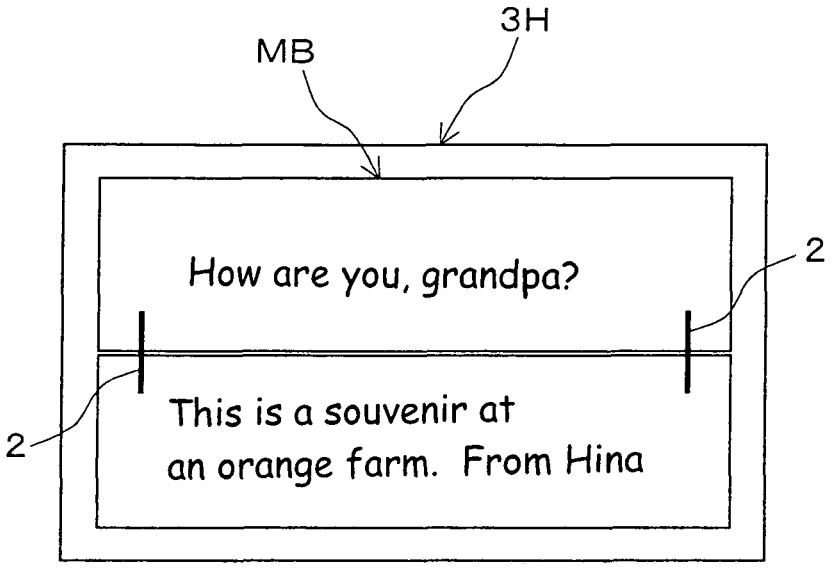
FIG. 8 shows a front view of a message board with a frame for showing the condition when a message board is fitted in a frame which is made from the pad member shown in FIG. 7.

When the recipient opens the cardboard box 1, the recipient can cut out the message board MB straddling the two outer flaps 1B, 1B on the top surface of the cardboard box 1 along the perforated line 1C, 1C. The recipient can open the cardboard box 1 by cutting out the message board MB keeping staples 2, 2 or removing the staples 2, 2. And then, the recipient can take out the three bottles of jam BJ, the frame assemble instruction drawing (not shown in drawings) and the order form for new articles OS from the inside of the cardboard box 1, After the recipient takes out the frame assemble instruction drawing (not shown in drawings), the recipient folds the pad member 3 and converts the pat member 3 to a frame according to the instruction. As shown in FIG. 6, four fold pieces 3E are cut out from the bottom surface of the pad member 3 along the perforated line 3F (see FIG. 4), each of the fold pieces 3E is respectively folded toward the inner side along the four sides of the rectangular mountain fold line 3D, and then the frame 3H shown in FIG. 7 is assembled. As shown in FIG. 8, the message board MB is fitted in the inner side of the frame 3H and is made as a remembrance.

The frame 3H for setting up the message board MB as a remembrance is made by folding the pad member 3 for supporting three bottles of jam so that the pad member 3 is converted to the frame 3H. The message board MB is cut out from the two outer flaps 1B, 1B of the cardboard box 1 for containing three bottles of jam BJ and has the staples 2, 2.

Therefore, whenever the recipient sees it, the recipient recalls the fond memory at the time of delivery of the three bottles of jam BJ.

The recipient can take out the new order form for articles OS, fill the necessary items in the order form OS and order the new articles easily and certainly by sending it via facsimile, for example. If the recipient as the sender of new articles handwrites a particular individual message addressed to a recipient in the message space, a copy of the handwritten message is displayed on the message board MB of a cardboard box 1 for new articles.

As explained in the above, in the cardboard box 1 according to the first embodiment of the present invention, a particular individual message addressed to a recipient from a sender of articles is displayed on the message board MB which straddles the two outer flaps 1B, 1B forming the top surface of the cardboard box and which is partitioned so that the message board can be cut out from the two outer flaps, thereby the particular individual message is conveyed to the recipient of articles. The recipient of articles can keep the message boards MB displaying the particular individual message as a remembrance by cutting out the message board from the two outer flaps.

In this case, as the particular individual message is a copy of handwritten message by the sender of articles, the warm mind and personal image of the sender can be conveyed to the recipient, and therefore the value of the message board as a remembrance is increased.

The structure of the pad member 3 in a packing member for articles according to the first embodiment shown in FIG. 4, i. e. the structure for converting the pad member 3 to a frame for supporting the message board MB by fitting the message board in the frame is only one example. As long as it can support the message board MB by fitting the message board in the frame, it can be modified to any structure. The message board MB can be fitted in the frame 3H either with staples 2, 2 by keeping the staples 2, 2 on the outer flaps as shown in FIG. 8 or without staples 2, 2 by removing the staples 2, 2 from the outer flaps.

Next, a second embodiment of the present invention will be explained. A packing member for articles according to a second embodiment is configured as a cardboard box 11 shown in FIG. 9 and FIG. 10. A pad member 3 for supporting three bottles of jam is fitted inside of the cardboard box 11. As the structure of the pad member 3 is same as that for the embodiment shown in FIG. 3 and FIG. 4. it will not be explained in detail.

Figure 9:
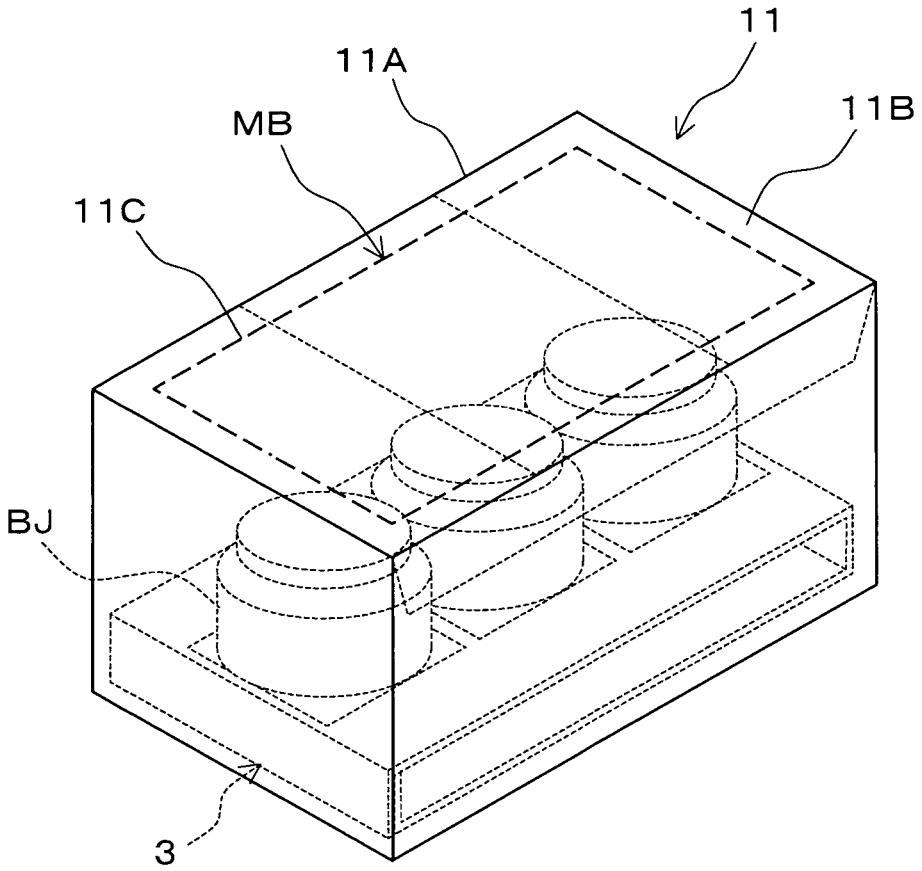
FIG. 9 shows a perspective view for showing the appearance of a cardboard box as a packing member for articles according to a second embodiment of the present invention.

As shown in FIG. 9, it includes one landscape outer flap 11B folded toward the inside along a ridge line 11A which extends to the longitudinal direction. A rectangular message board MB as a message display portion is partitioned by a perforated line 11C on the outer flap 11B so that the message board can be cutout from the outer flap.

Figure 10:
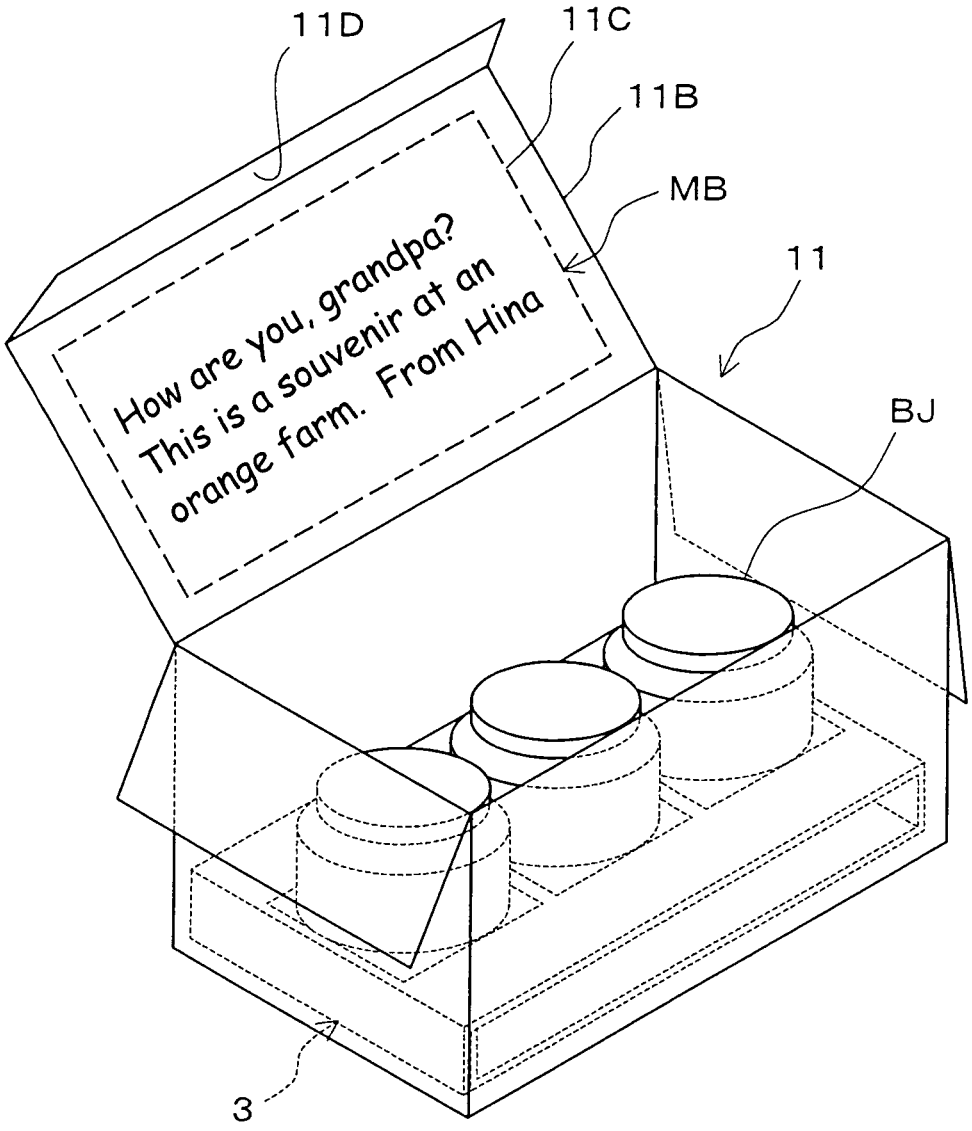
FIG. 10 shows a perspective view for showing the condition when an outer flap of the cardboard box shown in FIG. 9 is opened.

As shown in FIG. 10, a particular individual message which is similar to that shown in FIG. 2 is displayed on the inner surface of the message board MB by a similar means. An insert piece 11D for closing the top surface of the cardboard box 11 is formed by folding at the tip portion of the outer flap 11B.

In a packing member for articles according to the second embodiment, when a recipient of articles opens the outer flap 11B which constitutes the top surface of the cardboard box 11, the recipient can see the particular individual message which is displayed on the message board on the inner surface of the outer flap, and therefore the mind of a sender of articles can be conveyed to a recipient by the particular individual message. In this configuration, it is possible to prevent other people (excluding the recipient of articles) from seeing the particular individual message, and therefore the sender of articles can display a particular individual message without regard for what others think about the message.

The message board MB with a particular individual message on it can be cutout as a remembrance from the outer flaps 11B which forms the top surface of the cardboard box 11. As shown in FIG. 8, the message board MB can be set up by fitting in the inside of the frame 3H. Accordingly, a packing member for articles according to the second embodiment can exercise operations and results which are similar to those of a packing member for articles according to the first embodiment.

Next, a third embodiment of the present invention will be explained. A packing member for articles according to a third embodiment is configured as a packing box 21 shown in FIG. 11 and FIG. 12. The packing box 21 comprises a plastic box 21A with a rectangular opening on the top surface and a plastic cover 21B having one side which is integrally-molded with the box 21A. The other three sides of the plastic cover 21B are formed separate from the box 21A. The packing box 21A is molded by a colored transparent or translucent polyethylene or polypropylene material and the color of the material is a light color which is connected to the color of the packed articles, e.g. a light orange color which is connected to oranges.

An accordion structure portion 21C is formed on the upper portion of the box 21A so that the volume is adjusted by elongating and contracting the accordion structure portion in the upward or downward direction. For example, when the accordion structure portion 21C is contracted, 3 kg of oranges can be packed in the box, and when the accordion structure portion 21C is stretched, 5 kg of oranges can be packed in the box.

The cover 21B is a semi-closing cover which covers the three sides of the rectangular opening of the box 21A, and it is integrally-molded with the remaining one side of the top surface of the box 21A. The color of the cover 21B is a transparent or translucent light orange color which is same as that of the box 21A.

A separate message sheet 22 as the message display portion is attached to the inner surface of the cover 21B so that the message sheet can be peeled-off from the cover 21B. A particular individual message like the message explained in the above is displayed on the message sheet 22. That is to say, the message sheet 22 displaying a particular individual message is attached to the inner surface of the cover 21B by a weak adhesive so that the message sheet can be peeled-off from the cover.

The material for the message sheet 22 is not limited to any particular material as long as a particular individual message can be displayed on it and it can be attached to the inner surface of the cover 21B through a weak adhesive and various kind of thick paper or plastic sheet can be used for the message sheet 22.

The particular individual message is displayed by a means according to the material of the message sheet 22. That is to say, it is displayed by a copy through a handheld printer or by a handwriting using an appropriate writing material, e.g. an oiliness pen, a waterborne pen, a crayon, a crayon pastel, In a packing member for articles according to the third embodiment, when a recipient of articles opens the cover 21 of the packing box 21, the recipient can see the particular individual message which is displayed on the message sheet which is attached to the inner surface of the cover, and therefore the mind of the sender of articles can be conveyed to the recipient by the particular individual message. In this configuration, it is possible to prevent other people (excluding the recipient of articles) from seeing the particular individual message, and therefore the sender of articles can display a particular individual message without regard for what others think about the message.

The message sheet 22 with a particular individual message on it can be peeled-off from the inner surface of the cover 21B and can be kept as a remembrance. The message sheet 22 can be set up by attaching to an appropriate mat board. Accordingly, a packing member for articles according to the third embodiment exercises operations and results which are similar to those of a packing member for articles according to the first embodiment.

Furthermore, in a packing member for articles according to the third embodiment, it is easily adapted to packing of either 3 kg or 5 kg of fruits like oranges by adjusting the volume of the box 21A (packing box 21) by elongating or contracting the accordion structure portion 21C. The packing box 21 can be reused by peeling-off the message sheet 22 displaying a particular individual message from the inner surface of the cover 21B of the packing box 21.

Figure 11:
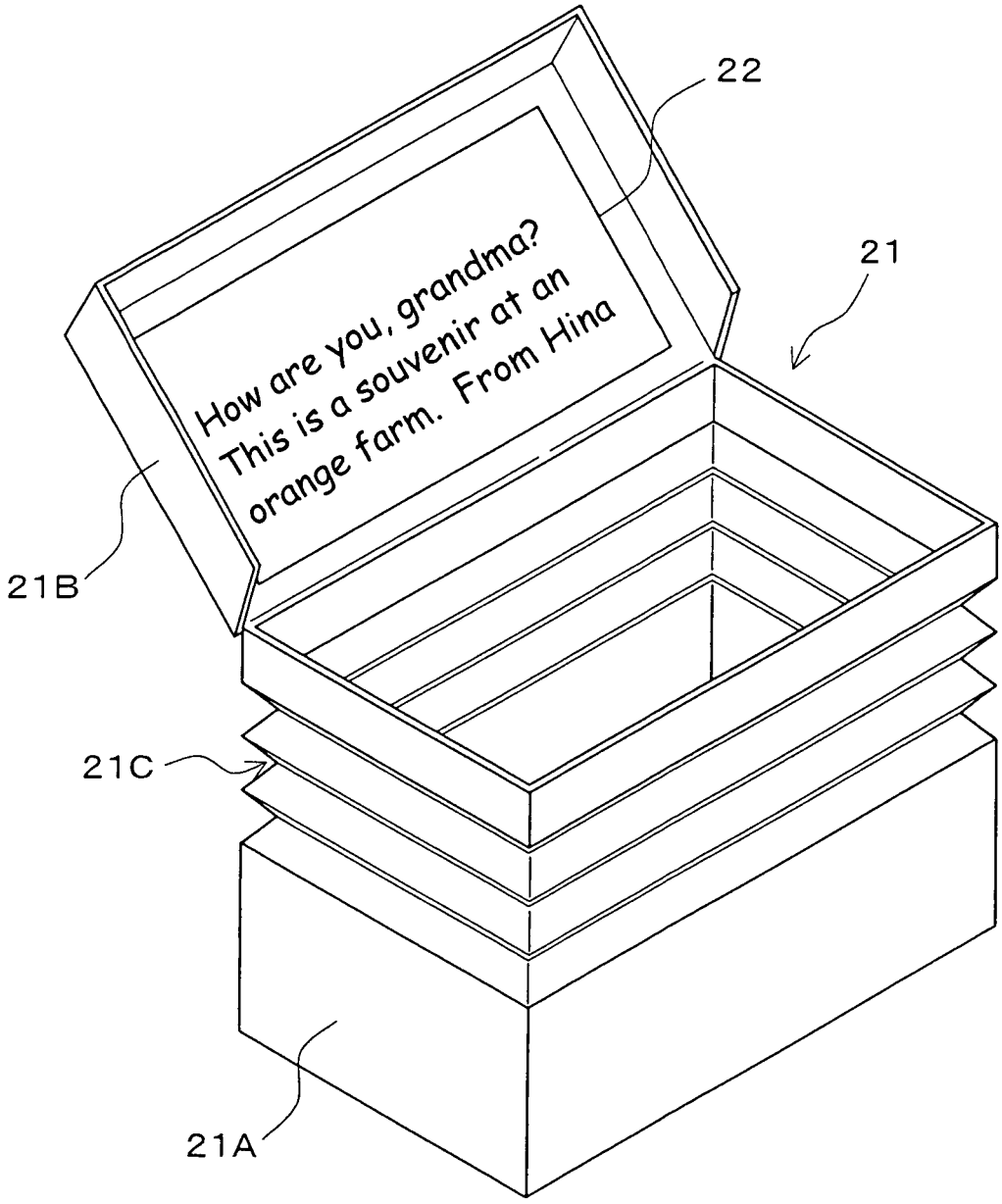
FIG. 11 shows a perspective view for showing the condition when a cover of a packing box as a packing member for articles according to a third embodiment of the present invention is opened.
Figure 12:
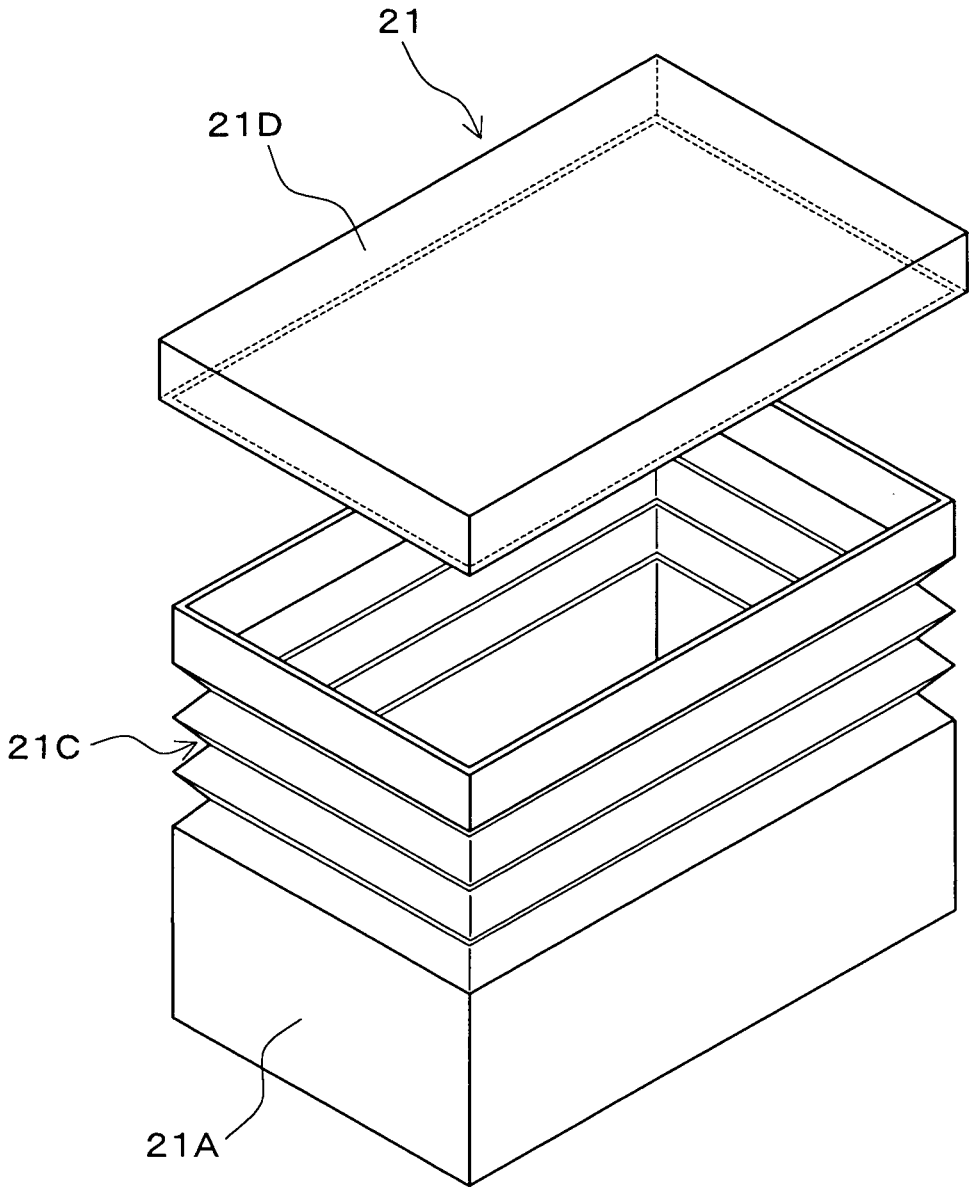
FIG. 12 shows a perspective view for showing a modified example of the caver of the packing box shown in FIG. 11.

The cover 21B of the packing box 21 shown in FIG. 11 can be changed to a normal closing cover 21D which is separate from the box 21A with the accordion structure portion 21C as shown in FIG. 12. The material of the closing cover 21D can be same as the material of box 21A or different from the material of box 21A, however it is preferable to use a transparent or translucent polyethylene or polypropylene material.

A message sheet (not shown in drawings) which is similar to the separate message sheet 22 shown in FIG. 11 is attached to the inner surface of the closing cover 21D shown in FIG. 12 so that the message sheet can be removed from the cover. A packing box 21 shown in FIG. 12 can exercise operations and results which are similar to those for a packing box 21 shown in FIG. 10 and FIG. 11.

Figure 13:
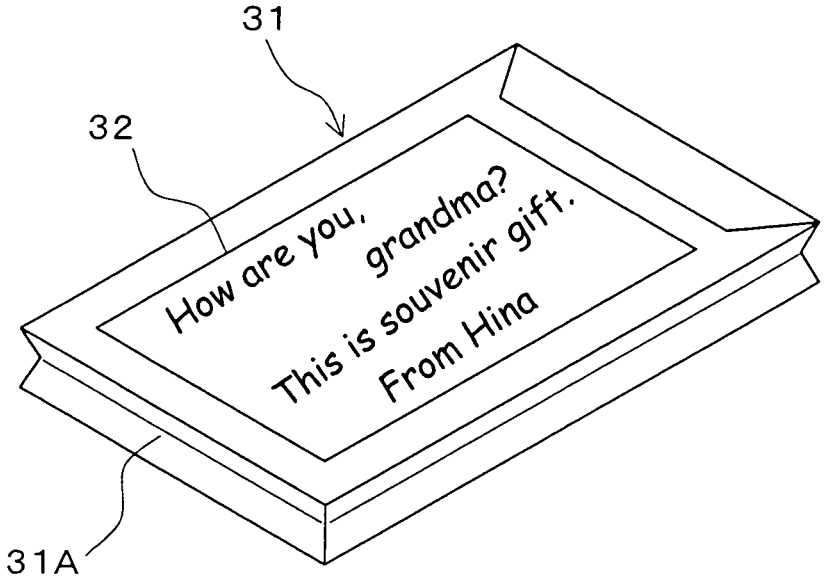
FIG. 13 shows a perspective view for showing the rear surface side of a packing bag as a packing member for articles according to a fourth embodiment of the present invention.

Next, a fourth embodiment of the present invention will be explained. A packing member for articles according to a fourth embodiment is configured as an envelope shape packing bag 31 as shown in FIG. 13. The packing bag 31 has an expandable portion 31A at the surrounding surface and can contain thin and flat articles like CDs, DVDs, magazines, T-shirts, etc.

A message sheet 32 which is similar to the message sheet 22 shown in FIG. 11 is attached to the rear surface of the packing bag 31 by e. g. an acrylic weak adhesive so that the message sheet 32 can be peeled-off. A similar particular individual message is displayed by a means which is similar to the particular individual message displayed on the message sheet 22.

The message sheet 32 with a particular individual message can be peeled-off from the rear surface of the packing bag 31 and can be kept as a remembrance. The message sheet 32 can be set up by attaching to an appropriate mat board.

Accordingly, a packing member for articles according to the fourth embodiment exercises operations and results which are similar to those for a packing member for articles according to the first embodiment.

The scope of the present invention should not be limited to the aforementioned embodiments. For example, the cardboard box 1 shown in FIG. 1, the cardboard box 11 shown in FIG. 9 and FIG. 10 and the packing box 21 shown in FIG. 12 can be used for packing not only bottles of jam or oranges but also other citrus, other fruits, e.g. apples, peaches, pears, or other kind of foods, sweets, dolls, toys, books. The packing bag 31 shown in FIG. 13 can be used for packing watches or small size electronic devices, e.g. cellular phones. A packing material for articles according to the present invention can be configured as a small size paper box for packing cakes.

The cardboard box 1 shown in FIG. 1, the cardboard box 11 shown in FIG. 9 and FIG. 10 and the packing bag 31 shown in FIG. 13 can be configured by a translucent plastic cardboard sheet so that the packed articles can be seen through the translucent plastic cardboard sheet. In this case, it is preferable to use a transparent or translucent cardboard sheet with a light color which is connected to the color of the packed materials, e.g. a light pink which is connected to the color of peaches.

The particular individual message displayed on the outer surface of the separate message sheet 22 shown in FIG. 11 can be handwritten on the inner surface of the cover 21B by an oiliness pen instead of the outer surface of the message sheet 22. In this case, the message sheet 22 can function as a cover sheet which covers the particular individual message by using a transparent plastic message sheet and attaching it to the inner surface of the cover 21B by a weak adhesive.

In this case, a week adhesive layer on the rear surface of the transparent message sheet 22 can transcribe the particular individual message which is handwritten on the inner surface of the cover 21B using an oiliness pen. It is possible to keep the message sheet 22 as a remembrance by peeling off the transparent message sheet 22 from the inner surface of the cover 21B and transcribing the particular individual message to the rear surface. The message sheet 22 can be set up by sticking on a mat board.

The shape and number of the recesses formed on the top surface of the pad member 3 (shown in FIG. 3) which is fitted in the bottom portion of the cardboard box 1 shown in FIG. 1, the cardboard box 1 shown in FIG. 9 and FIG. 10 can be an any appropriate shape and number.

The invention claimed is:

1. A packing member for articles, comprising:

a box shaped packing member having two flaps on a top surface of the packing member for sending the articles to a recipient, and a message display portion removable from the packing member for displaying a particular individual message addressed to the recipient from a sender of the articles, wherein the message display portion straddles the two flaps and the message display portion is removable from the two flaps, and the two flaps are connected to each other by a staple.

2. A packing member for articles according to claim 1, wherein the particular individual message is displayed at least either on an inner surface or on an outer surface.

3. A packing member for articles according to claim 1, wherein the packing member is made of a plastic material.

4. A packing member for articles according to claim 1, wherein a frame configured to set up a separated message display portion is contained in the packing member together with the articles.

5. A packing member for articles according to claim 4, wherein the packing member comprises a pad member configured to support the articles, and the pad member has a structure convertible to the frame.

6. A packing member for articles according to claim 1, wherein the particular individual message displayed in the message display portion is a handwritten message by the sender or a copy of the handwritten massage.

7. A packing member for articles according to claim 1, wherein the packing member contains articles together with an order form for new articles in the packing member, and the order form includes a message space for handwriting the particular individual message.

8. A packing member for articles according to claim 7, wherein the order form for new articles has a removable message sheet thereon.

9. A packing member for articles according to claim 4, wherein the message display portion and the frame have a substantially same size so that the message display portion fits into the frame.

10. A packing member for articles according to claim 1, wherein the message display portion forms a part of the two flaps, a border between the message display portion and the part of the two flaps is perforations, and the message portion is removable by cutting the perforations.

11. A packing member for articles according to claim 1, wherein the message display portion is present on the top surface.

* * * * *